US005964638A

United States Patent [19]

Emerson

[11] Patent Number: 5,964,638

[45] Date of Patent: Oct. 12, 1999

[54] MANUALLY ACTUATED FIGURE TOY

[76] Inventor: Anthony G. Emerson, 1739 So. Avington Ave., West Covina, Calif. 91792

[21] Appl. No.: 08/944,721

[22] Filed: Oct. 6, 1997

[51] Int. Cl.[6] ..... A63H 3/36; A63H 3/20

[52] U.S. Cl. ..... 446/339; 446/359; 446/365; 446/367; 446/376

[58] Field of Search ..... 446/352, 313, 446/367, 376, 329, 333, 327, 339, 359, 365

[56] References Cited

U.S. PATENT DOCUMENTS

| | | | |
|---|---|---|---|
| 1,648,411 | 11/1927 | Lemieux . | |
| 2,614,365 | 10/1952 | Musselwhite et al. | 46/119 |
| 2,633,670 | 4/1953 | Steuber | 46/154 |
| 3,672,097 | 6/1972 | Gardel | 446/352 |
| 3,856,304 | 12/1974 | Matsumoto | 273/440.1 |
| 4,040,206 | 8/1977 | Kimura | 446/352 |
| 4,091,563 | 5/1978 | Noble | 273/440.1 |
| 4,244,138 | 1/1981 | Holahan | 446/301 |
| 4,457,097 | 7/1984 | Miller | 446/327 |
| 4,585,425 | 4/1986 | Amici et al. | 446/327 |
| 4,608,025 | 8/1986 | Amici et al. | 446/298 |
| 4,610,639 | 9/1986 | Piazza | 446/327 |
| 4,610,640 | 9/1986 | Amici et al. | 446/329 |
| 4,654,018 | 3/1987 | Farrington et al. | 446/38 |
| 4,666,419 | 5/1987 | Droller et al. | 446/330 |
| 5,167,562 | 12/1992 | Axtell | 446/329 |
| 5,478,269 | 12/1995 | Wolfram | 446/330 |
| 5,730,638 | 3/1998 | Ward | 446/297 |

*Primary Examiner*—Robert A. Hafer
*Assistant Examiner*—Kurt Fernstrom
*Attorney, Agent, or Firm*—Jack C. Munro

[57] ABSTRACT

The subject invention is a figure toy which is to be grasped and manipulated by a child. By way of example, the figure toy could comprise a bird. The child can manually maneuver the toy through the air resembling a bird in flight. The child can also depress a first lever which will result in the flapping of the wings of the bird. The child can also depress a second lever which will result in the extension of the legs of the bird. A third lever is to be actuatable which will result in the moving of the feet of the bird to a grasping position with the feet being capable of grasping onto and holding exterior objects. The object can then be released at a desired time. An annunciator button can be actuated which will also result in emission of a bird-like noise, as well as illumination of the eyes of the bird.

3 Claims, 4 Drawing Sheets

MANUALLY ACTUATED FIGURE TOY

BACKGROUND OF THE INVENTION

1) Field of the Invention

The field of this invention relates to toys, and more particularly to a toy which is to be held by a hand of a child with the toy to be maneuvered within the air and, during the maneuvering, to simultaneously perform certain motions that are initiated by the child.

2) Description of the Prior Art

Manually operated toys have long been known. Common forms of manually operated toys are a hand held glider, a doll, as well as numerous other types of toys.

In order to design any toy and make it desirable for use by a child, the toy must be attractive, interesting to operate and produce an element of excitement for the child during its use. It is also advantageous for the toy to be educational and essential it will not harm the user.

In the past, toys have been manufactured to be replicas of certain animals. For example, there are toys that resemble elephants, bears, cats, lions, tigers and birds, as well as numerous other animals. It is desirable to not only manufacture a toy to replicate a particular animal, but also to incorporate within that toy some of the normal movements of that animal thereby making the use of the toy interesting to the child and educational.

SUMMARY OF THE INVENTION

A primary objective of the present invention is to construct a figure toy which can be operated by a child at play, in a manner to essentially duplicate natural movements of the animals whose figures are represented.

Another objective of the present invention is to construct a figure toy that can be manipulated by the child in a manner that produces an element of excitement for the child.

Another objective of the present invention is to construct a toy that is interesting and educational.

The figure toy of the present invention will be discussed in relation to the figure of a bird. However, it is to be within the scope of this invention that other figures could be utilized. The body of the figure toy has a handle fixedly mounted thereon. Mounted in conjunction with the body is a pair of wings and a pair of legs. The head of the figure toy includes eyes with the eyes including light emitting devices. At the end of each of the legs are mounted feet with the feet being movable to grasp onto and pick up an exterior object. Associated with the handle are three levers with one lever, when operated, to cause flapping of the wings, the second lever to cause extension of the legs and the third lever to move the feet into the grasping position. Also associated with the handle is an annunciator button which when actuated will cause the eyes of the figure to illuminate and also produce sound resembling the call of the bird.

DETAILED DESCRIPTION OF THE PREFERRED EMBODIMENT

Figure 1:
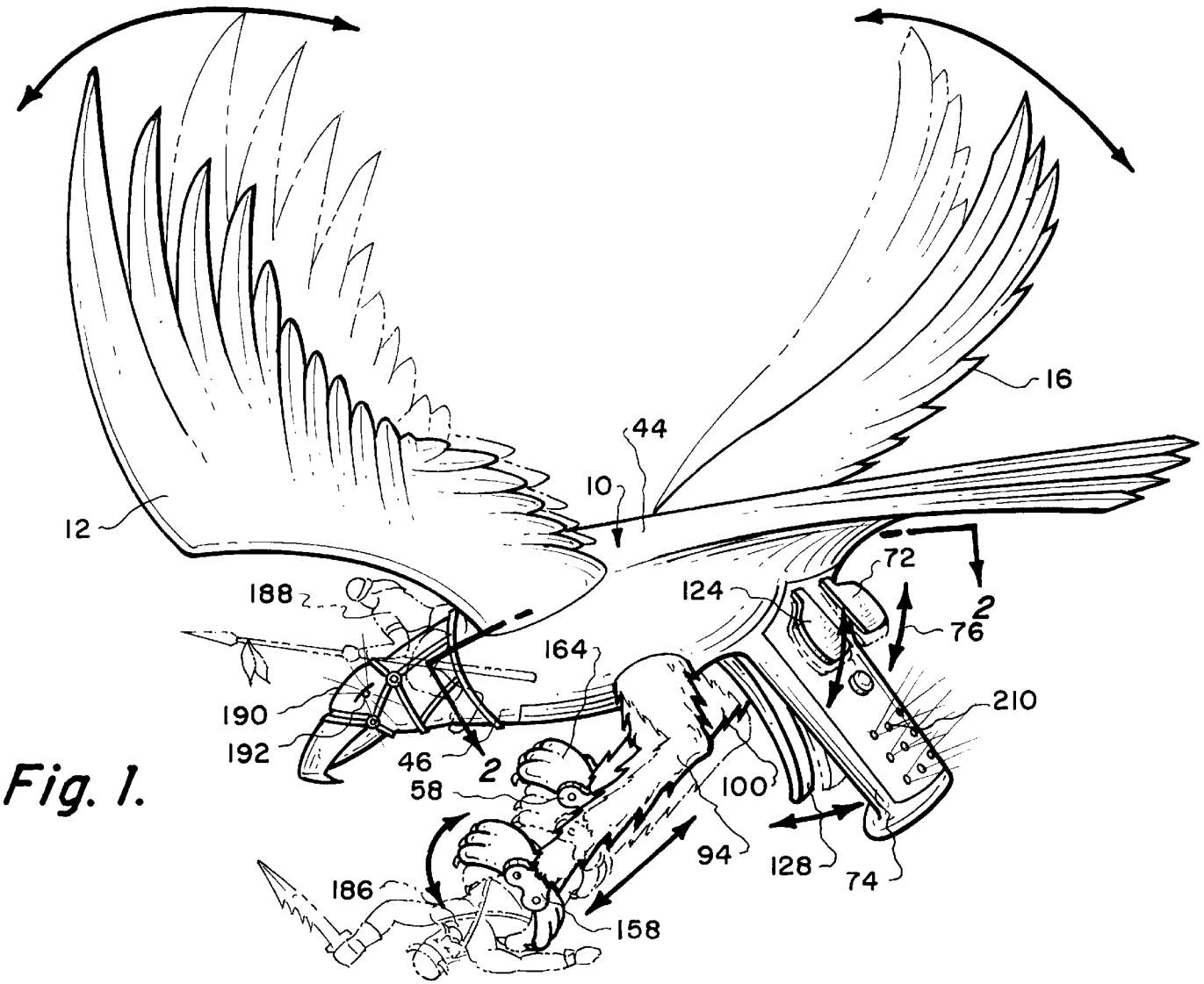
FIG. 1 is an isometric view showing the figure toy of the present invention in a typical mode of operation.
Figure 2:
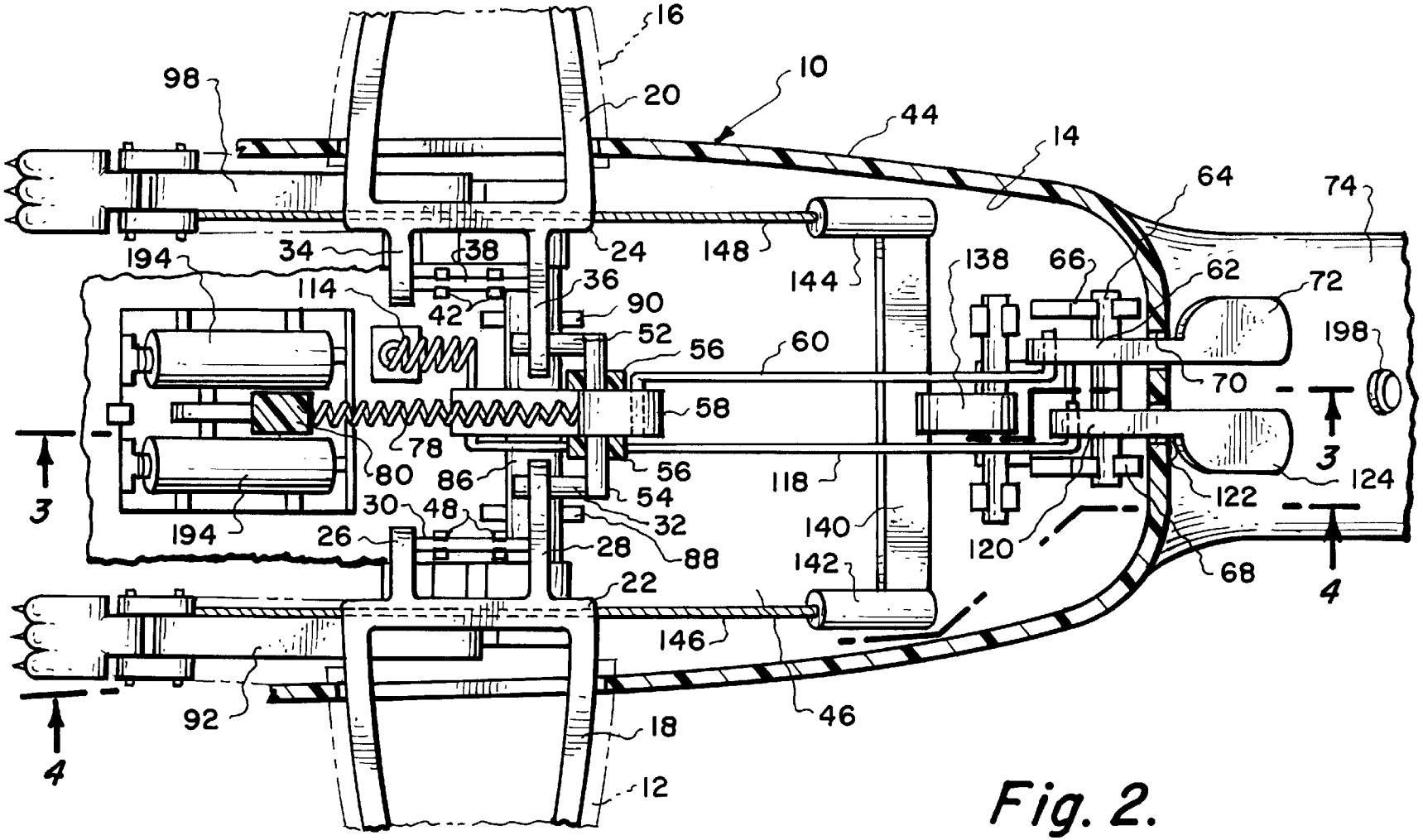
FIG. 2 is a longitudinal, cross-sectional view through the body of the figure toy of the present invention taken along line 2—2 of FIG. 1.

Referring particularly to FIG. 1 of the drawings, there is shown the shell which is formed into a figure body 10 which is shown to be in the configuration of a bird. However, it is considered to be within the scope of this invention that other types of animals could be represented by the figure body 10. Figure body 10 is constructed of sheet material and has an internal chamber 14. A typical material of construction for the figure body 10 would be a plastic.

Mounted in conjunction with the figure body 10 is a left wing 12 and a right wing 16. The left wing 12 includes a rigid interior frame 18 with the right wing 16 including a similar rigid interior frame 20. The frame 18 has an inner portion 22 which is mounted within the internal chamber 14. The frame 20 also includes a similar inner portion 24 which is also mounted within the internal chamber 14. Mounted on the inner portion 22 is a short bracket 26 and a long bracket 28. The short bracket 26 and the long bracket 28 basically form a bifurcated mounting arrangement for a rod 30. The long bracket 28 includes a recess, which is not shown, with a rod 32 to be mounted within this recess.

In a similar manner, the inner portion 24 has mounted thereon a short bracket 34 and a long bracket 36 located in a spaced-apart arrangement. Mounted between the short bracket 34 and the long bracket 36 is a rod 38. The rod 38 is lineally fixed in position relative to the figure body 10 by means of a pair of upper members 40 and a pair of lower members 42. The upper members 40 are fixedly mounted onto the upper wall 44 of the figure body 10 with the lower members 42 being fixedly mounted onto the lower wall 46 of the figure body 10. In a similar manner, the rod 30 is mounted between a pair of lower members 48 and pair of upper members (not shown). The lower members 48 are mounted on the inside surface of the lower wall 46 with the upper members (not shown) being mounted on the inside surface of the upper wall 44.

It is the function of the members 40 and 42 to capture the rod 38 and hold it in a fixed relationship relative to the figure body 10 but permitting the rod 38 to pivot. The same occurs in relation to the rod 30. The long bracket 36 includes a recess 50 within which is mounted a rod 52. The rods 32 and 52 are fixedly mounted to opposite ends of a pivot pin 54. Pivot pin 54 is pivotly mounted to a pair of members 56 which are integrally mounted to the upper wall 44 and extend within the internal chamber 14. Between the pair of members 56 is located an extension 58. The extension 58 includes a hole within which is located one end of a rod 60. The opposite end of the rod 60 is mounted within a hole formed within the inner end of a lever 62. The lever 62 is pivotly mounted by means of a pivot pin 64. A pair of upstanding members 66 and 68 are fixedly mounted onto the lower wall 46 of the figure body 10. The lever 62 protrudes through hole 70 formed in the figure body 10 with the portion of the lever 62 that extends exteriorly of the figure body 10 being formed into flattened section 72. The flattened section 72 is spaced from, but located directly adjacent, the surface of a handle 74 with this handle 74 being integrally mounted to the lower wall 46 of the figure body 10.

Figure 3:
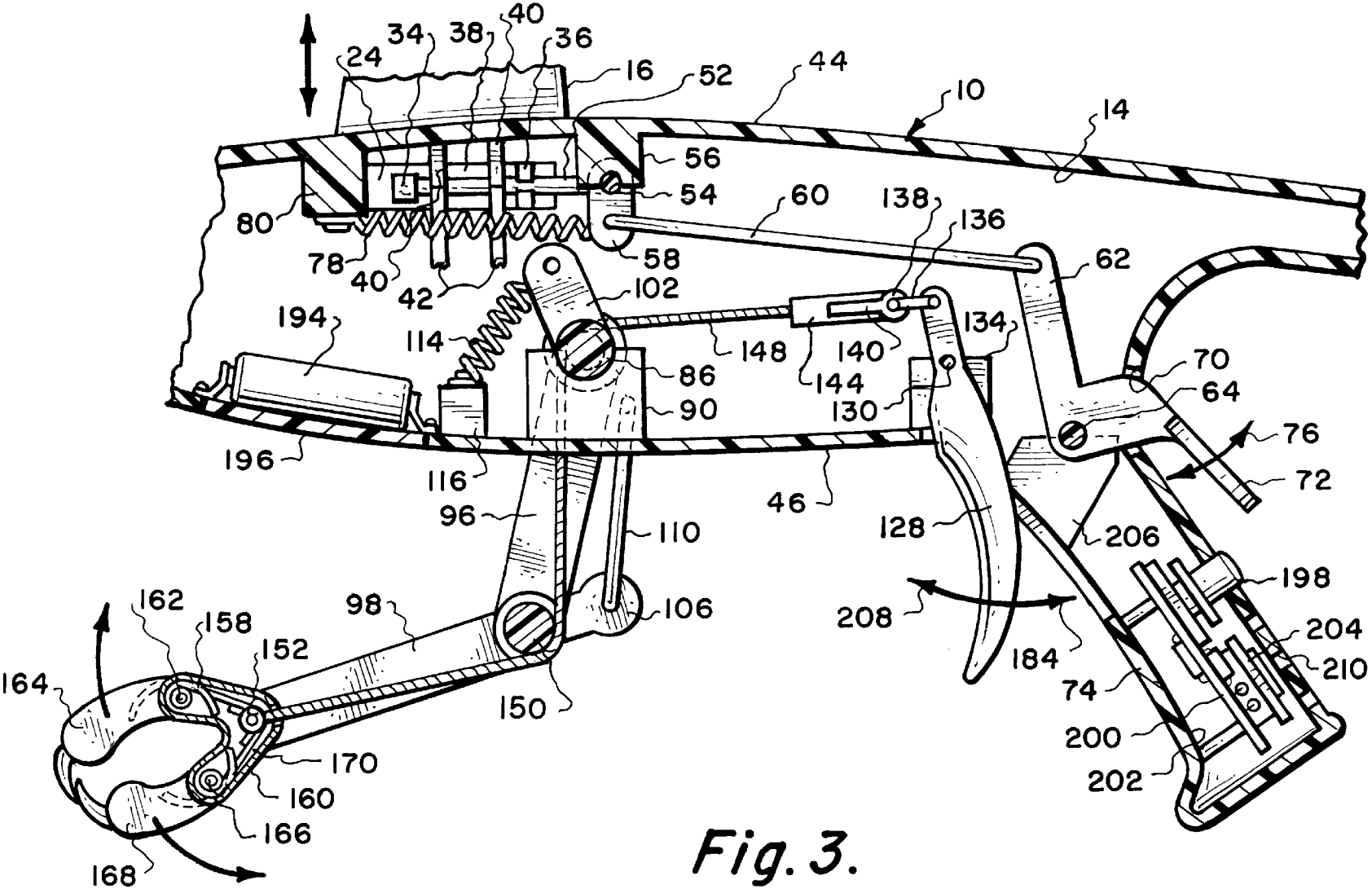
FIG. 3 is a longitudinal, side cross-sectional view through the body of the figure toy of the present invention taken along line 3—3 of FIG. 2.
Figure 4:
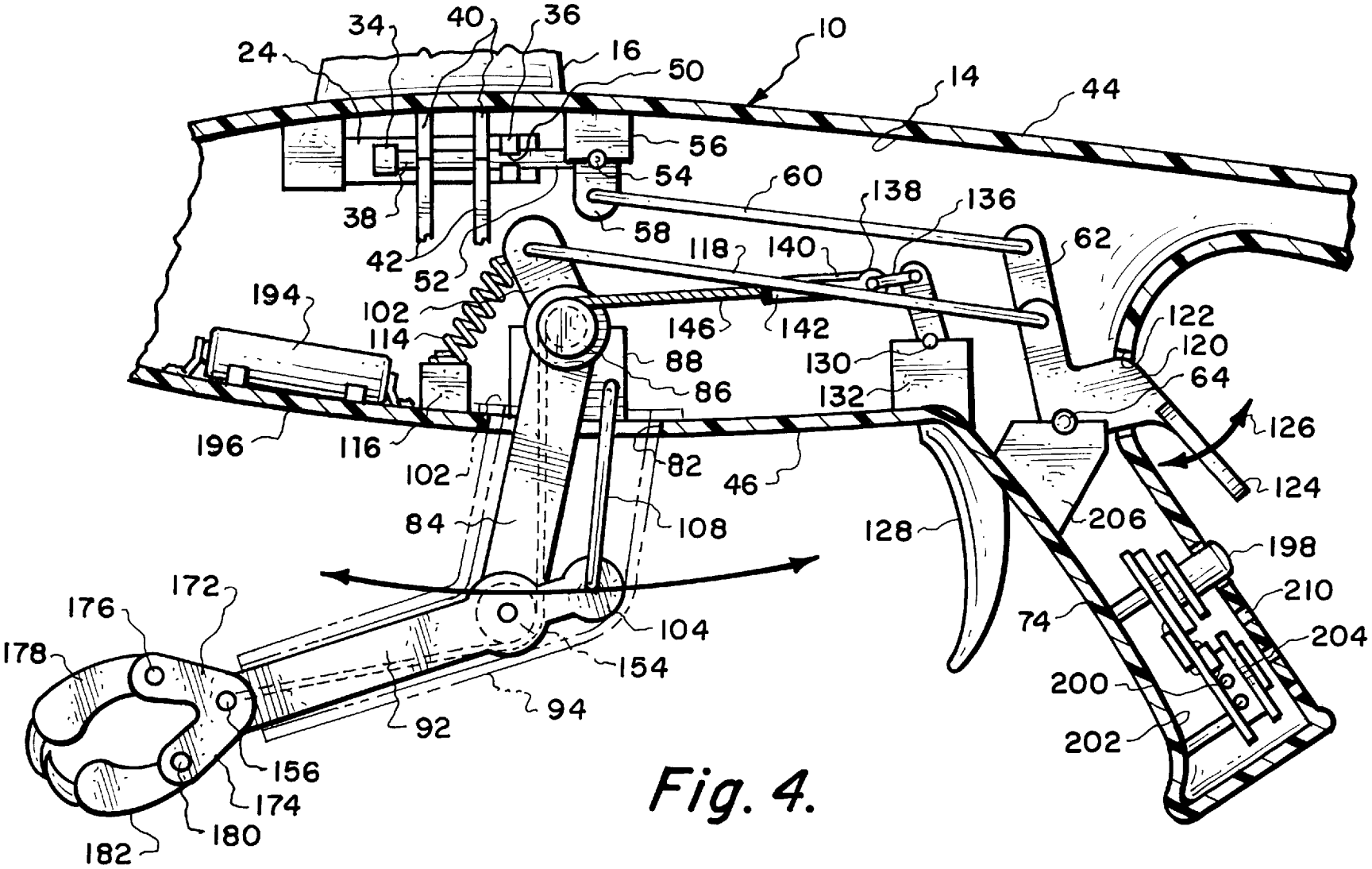
FIG. 4 is a longitudinal, side cross-sectional view through the body of the figure toy of the present invention taken along line 4—4 of FIG. 2.

The user, who commonly is a child, is to grasp the handle 74 and is to be able to use his or her thumb or a free finger to apply a downward pressure on the flattened section 72. The flattened section 72 pivots about the pivot pin 64 in the direction depicted by arrow 76. When the flattened section 72 is pushed in a direction toward the handle 74, the rod 60 is moved toward the aft end of the figure body 10. This causes the extension 58 to pivot about the pivot pin 54 with the rods 32 and 52 being caused to move in a counterclockwise direction as shown in FIGS. 3 and 4. This will result in the long brackets 28 and 36 being forced in a direction toward the bottom wall 46. As a result, frames 18 and 20 pivot relative to their mounting rods 30 and 38. The wings 12 and 16 will then be caused to move in an upward direction. Releasing of the child's finger from the flattened section 72 will result in the extension 58 being pivoted back to its initial position by the action of coil spring 78. The outer end of the coil spring 78 is fixedly mounted onto member 80 which is integrally mounted to the upper wall 44 which extends within the internal cavity 14. This will result in the wings 12 and 16 then pivoting in a downward direction. Subsequently, with the child repetitively pushing on the flattened section 72, the wings 12 and 16 will flap similarly to the wing flapping of a bird.

Extending through a hole 82, formed within the lower wall 46, is an upper leg link 84. The inner end of upper leg link 84, which is located within the internal chamber 14, is mounted on a large pivot rod 86. On this large pivot rod 86 is pivotly mounted a pair of mounting plates 88 and 90. The large pivot rod 86 is fixedly mounted onto the mounting plates 88 and 90 with the exception that the large pivot rod 86 is capable of pivoting relative to the mounting plates 88 and 90. The outer end of the link 84 is pivotly mounted to a lower leg link 92. Links 84 and 92 are covered by a skin 94 which is formed to resemble feathers. It is to be understood that links 84 and 92 and skin 94 form a left leg with there being also a similar right leg composed of an upper leg link 96 to which is pivotly mounted a lower leg link 98. The upper leg link 96 is also pivotly mounted to the large pivot rod 86. The links 96 and 98 are similarly covered by a skin 100 which is basically identical to the skin 94. The upper end of the skin 94 includes a mounting flange 102 which is used to secure the skin 94 to the lower wall 46 by the flange 102 being placed in abutting contact with the inside surface of the lower wall 46. It is to be understood that the skin 100 has a similar such mounting flange, which is not shown.

The lower leg link 92 has a rear extension 104. Similarly, the lower leg link 98 has a rear extension 106. A rod 108 is pivotly connected to the rear extension 104. A similar rod 110 is connected to the rear extension 106. The upper end of the rod 108 is located within the internal chamber 14 and is mounted within a hole formed in the mounting plate 88. In a similar manner, the upper end of the rod 110 is pivotly mounted within a hole formed within the mounting plate 90.

Fixedly mounted onto the large pivot rod 86 is a mounting flange 102. Coil spring 114 interconnects between the mounting flange 102 and a block 116 which is fixedly mounted to the inside surface of the lower wall 46. It is the function of the coil spring 114 to apply a continuous torque to the upper leg link 84 tending to locate such in the position shown in FIGS. 3 and 4 of the drawings. However, a force can be applied through rod 118 which is connected to a lever 120. Lever 120 is also pivotly mounted on the pivot pin 64. The lever 120 extends through a hole 122 formed within the figure body 10. The lever 120 includes a flattened section 124 which is mounted directly adjacent the flattened section 72 and spaced slightly from the handle 74. The child applying a downward pressure in the direction of arrow 126 against the flattened section 124 moving the flattened section 124 toward the handle 74 will result in the rod 118 being extended and the mounting flange 102 being pivoted against the bias of the coil spring 114. This results is a clockwise pivoting of the upper leg link 84 and a counterclockwise pivoting of the lower leg link 92 which is caused by the connection of rod 108 between rear extension 104 to the mounting plate 88. The net effect is that the leg, which is formed by upper leg link 84 and lower leg link 92, assume a substantially straightened configuration. This straightened configuration is also simultaneously achieved by the upper leg link 96 and the lower leg link 98. Both of the legs of the figure body 10 are extended and retracted simultaneously.

Flattened sections 72 and 124 are mounted directly to the rear surface of the handle 74. Mounted directly adjacent the front surface of the handle 74 is a lever 128. This lever 128 is capable of being pivoted by the child, usually by means of the forefinger of the hand that is grasping onto the handle 74. The lever 128 extends to within the internal chamber 14 and is mounted by means of a pivot pin 130 between a pair of mounting plates 132 and 134. The mounting plates 132 and 134 are integrally connected to the lower wall 46. The upper end of the lever 128 is pivotly attached to a rod 136. Rod 136 is pivotly connected to a fixed link 138. The fixed link 138 is integrally connected to a transverse bar 140. At one end of the transverse bar 140 is mounted a first cable connector 142 and at the opposite end of the transverse bar 140 is mounted a second cable connector 144. A first cable 146 connects to the first cable connector 142 and a second cable 148 connects to the second cable connector 144. The second cable 148 is conducted around large pivot rod 86 down along upper leg link 96 and around pivot joint 150 which connects the upper leg link 96 to the lower leg link 98. The outer end of the second cable 148 is attached to a pin 152. In a similar manner, the first cable 146 is conducted around the large pivot rod 86 down alongside the upper leg link 84 and around pivot joint 154 which interconnects the upper leg link 84 to the lower leg link 92. The outer end of the first cable 146 is attached to a pin 156.

The lower leg member 98 is bifurcated at its outer end forming a branch 158 and a branch 160. Branch 158 is pivotly connected by a pin 162 to a forward foot member 164. In a similar manner, the branch 160 is connected by a pin 166 to a rearward foot member 168. An over-center leaf spring 170 connects with pin 152. The leaf spring 170 has a pair of ends with one such end being connected to the forward front foot member 164 and the other such end being connected to the rearward foot member 168. Pin 152 is movable within a slot (not shown) which is formed in the lower leg member 98. Movement of the pin 152 within its slot applies pressure against the leaf spring 170. Lower leg link 92 is similarly formed into two branches 172 and 174. The branch 172 connects by a pin 176 to a forward foot member 178. The branch 174 is connected by a pin 180 to a rearward foot member 182.

When the child pulls the lever 128 toward handle 74 in the direction of arrow 184, the transverse bar 140 moves toward mounting flange 102. The cables 146 and 148 are held in a taught configuration, and when the transverse bar 144 is moved toward the mounting flange 102, cables 146 and 148 are moved toward a slackened condition. This will permit the pins 152 and 156 to be moved within their respective slots (which are not shown) causing the leaf spring 170, which is operated by the cable 148 and the leaf spring (not shown) which is operated by the cable 146, to be moved to an over-center release position. This will result in the forward foot member 164 and the rearward foot member 168 to assume an almost in-line position, as is also the case for the forward foot member 178 and the rearward foot member 182. This almost inline position is depicted in solid lines in FIG. 1. In this position, the foot members 164, 168, 178 and 182 are not able to grasp any exterior object. However, when the forward foot members 164, 168, 178 and 182 are placed against an exterior object 186 and the child releases the lever 128 due to the action of the leaf springs, such as leaf spring 170, the foot members 164 and 168 are moved to the clasping position as shown in FIG. 3 and the foot members 178 and 182 are moved to the grasping position as shown in FIG. 4. This will grab onto and hold the exterior object 186. Release of the exterior object 186 can be accomplished in any desired time by again actuating the lever 128.

If the child user wishes, a separate exterior object 188, such as a warrior figure, can be placed on the head 190 of the bird figure. Included within the head 190 is a pair of eyes 192. These eyes 192 are to be electrically illuminatable with illumination to occur by a battery source 194 mounted on the inside surface of the lower wall 46 and within the internal chamber 14. Access into the battery source 194 is accomplished through a battery compartment access door 196. Illumination of the eyes 192 is to occur when the child user presses the button 198. The button 198 is mounted in conjunction with the handle 74. The button 198 operates against a printed circuit board 200 which is mounted within the interior chamber 202 on the handle 74. Also included with the printed circuit board 200 is a noise producing device 204. When the button 198 is depressed, not only do the eyes 192 illuminate, but also a screaming noise, such as an eagle type of bird would make, is to be produced by the noise producing device 204. Both the illumination of the eyes 192 and the noise producing device 204 constitute an annunciation.

The pivot pin 64 is mounted on mounting block 206 which is securely mounted on the wall surface of the internal chamber 202 of the handle 74. When the lever 128 is released, it is permitted to move in the direction of arrow 208 to its normal at-rest position, which is also the grasping position for the foot members 164, 168, 178 and 182. The wall surface of the handle 74 includes a series of holes 210 through which the sound is to be emitted from the noise producing device 204.

What is claimed is:

1. A manually actuated figure toy comprising:

a figure body having a fore end and an aft end, said figure body having an extendable member assembly, said figure body having a movable member assembly;

a handle attached to said figure body, said handle adapted to be grasped by the user, said handle having a front and a rear, said front being located closest to said fore end and said rear being located closest to said aft end;

a first lever mounted on said handle and connected to said movable member assembly, said first lever being movable to actuate to said movable member assembly relative to said figure body:

a second lever mounted on said handle and connected to said extendable member assembly, said second lever being movable to cause extension of said extendable member assembly relative to said figure body;

whereby the user can grasp said handle and manipulate said figure toy while simultaneously actuating said movable member assembly and said extendable member assembly by respectively moving said first lever and said second lever and;

a graspable member assembly mounted on said extendable member assembly, a third lever mounted in close proximity to said handle, said third lever being movable to actuate said graspable member assembly, said graspable member assembly being movable from an open position to a closed position, when in said closed position said graspable member assembly capable of grasping onto an exterior object and holding onto same.

2. The manually actuated figure toy as defined in claim 1 wherein:

said extendable member assembly comprising a pair of legs, said legs being movable from a retracted position to an extended position resembling the movement of the legs of a live bird, said graspable member assembly comprising a foot attached to each leg with there being two separate feet, said feet resembling the feet of a live bird.

3. The manually actuated figure toy as defined in claim 1 wherein:

said third lever being located directly adjacent to said rear of said handle.

* * * * *